US007706701B2

(12) United States Patent
Wakide

(10) Patent No.: US 7,706,701 B2
(45) Date of Patent: Apr. 27, 2010

(54) IMAGE FORMING APPARATUS, METHOD OF ACQUIRING TONER-CARTRIDGE INFORMATION AND TONER CARTRIDGE

(75) Inventor: Hitoshi Wakide, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 2 days.

(21) Appl. No.: 11/797,327

(22) Filed: May 2, 2007

(65) Prior Publication Data

US 2008/0124095 A1 May 29, 2008

(30) Foreign Application Priority Data

Nov. 27, 2006 (JP) ..... 2006-317980

(51) Int. Cl.
*G03G 15/00* (2006.01)
*G03G 15/08* (2006.01)

(52) U.S. Cl. ..... 399/12; 399/27

(58) Field of Classification Search ..... 399/12, 399/111, 112, 262, 119, 120
See application file for complete search history.

(56) References Cited

U.S. PATENT DOCUMENTS

| | | | | |
|---|---|---|---|---|
| 6,636,702 | B2 * | 10/2003 | Abe | 399/12 |
| 7,263,298 | B2 * | 8/2007 | Nagamine et al. | 399/12 |
| 2006/0159472 | A1 * | 7/2006 | Ushiroji et al. | 399/27 |
| 2007/0071458 | A1 * | 3/2007 | Tanaka et al. | 399/12 |
| 2007/0086793 | A1 * | 4/2007 | Otawa et al. | 399/12 |

FOREIGN PATENT DOCUMENTS

| | | | |
|---|---|---|---|
| EP | 1 168 099 | | 1/2002 |
| JP | 04-115273 | | 4/1992 |
| JP | 2001-066968 | | 3/2001 |
| JP | 2002-169429 | A | 6/2002 |
| JP | 2003-114567 | | 4/2003 |
| JP | 2003-291424 | | 10/2003 |
| JP | 2004-309945 | A | 11/2004 |
| JP | 2005-115157 | | 4/2005 |
| JP | 2005-134909 | | 5/2005 |
| JP | 2006-195232 | | 7/2006 |

OTHER PUBLICATIONS

European Search Report Application/Patent No. 07012711.3-2209 dated Apr. 2, 2008.
Notification of Reasons for Refusal issued in corresponding Japanese Patent Application No. 2006-317980 with English translation dated Jan. 20, 2009.

* cited by examiner

*Primary Examiner*—Sophia S Chen
(74) *Attorney, Agent, or Firm*—Buchanan Ingersoll & Rooney PC

(57) ABSTRACT

An image forming apparatus of the invention permits a toner cartridge equipped with a non-volatile memory storing various information items to be mounted in a mounting portion of an apparatus main body through a toner-cartridge mounting panel capable of being opened and closed without suspending an image forming operation. In a case where an opened/closed status of the toner-cartridge mounting panel is detected, the apparatus retrieves cartridge-specific information from the non-volatile memory of the toner cartridge. The other data than the cartridge-specific information is read out only from a non-volatile memory of a toner cartridge, the cartridge-specific information of which differs from cartridge-specific information stored in a memory of the apparatus main body.

9 Claims, 9 Drawing Sheets

IMAGE FORMING APPARATUS, METHOD OF ACQUIRING TONER-CARTRIDGE INFORMATION AND TONER CARTRIDGE

RELATED APPLICATION

This application is based on application No.317980/2006 filed in Japan, the contents of which are hereby incorporated by reference.

BACKGROUND OF THE INVENTION

1. Field of the Invention

The present invention relates to: an image forming apparatus such as copiers and printers; a method of acquiring toner-cartridge information from a toner cartridge removably mounted in such an image forming apparatus and equipped with a non-volatile memory; and a toner cartridge. Particularly, features of the invention reside in that the image forming apparatus permits the replacement of the toner cartridge without suspending an image forming operation of the image forming apparatus and in that confirmation of the mounted state of the toner cartridge, retrieval of information stored in the non-volatile memory of the mounted toner cartridge and such are accomplished easily.

2. Description of Related Art

The image forming apparatuses conventionally used, such as copiers and printers, include one in which a variety of cartridges containing various consumables, such as the toner cartridge containing therein a toner, are removably mounted in an apparatus main body.

In a case where the toner cartridge containing therein the toner is replaced, such an image forming apparatus requires a proper toner cartridge corresponding to an apparatus model or the like to be mounted therein in order to ensure proper image formation.

More recently, the following image forming apparatus has been proposed which employs a toner cartridge equipped with the non-volatile memory storing therein various information items including: cartridge-specific information such as an ID code; a color of the contained toner; toner quantity; use conditions; and the like. When this toner cartridge is mounted in the image forming apparatus, the image forming apparatus retrieves the information stored in the non-volatile memory so as to determine whether the mounted toner cartridge is proper or not (see Japanese Unexamined Patent Publications No.2002-169429 and No.2004-3309945).

The above image forming apparatus encounters the following problem when the toner cartridge is replaced. It is a common practice to temporarily suspend even an ongoing image forming operation before a front panel, a toner-cartridge mounting panel or the like is opened to replace the toner cartridge. The replacement of the toner cartridge involves the temporary suspension of the image forming operation, thus disabling a continuous image forming operation. Hence, image forming efficiency is lowered.

In order to form a full color image, the above image forming apparatuses is also adapted to permit a plurality of toner cartridges containing toners of different colors to be mounted in the apparatus main body.

In the image forming apparatus wherein the plural toner cartridges containing the toners of different colors are mounted, the apparatus main body is generally connected with the respective toner cartridges for discrete communication with the respective non-volatile memories thereof. Through such communications, the various information items stored in the respective non-volatile memories of the toner cartridges may be retrieved, or overwritten with new information.

However, problems of complicated wirings and control are encountered by the constitution wherein the apparatus main body is in discrete connection with the respective non-volatile memories of the toner cartridges for performing the discrete communication with the respective non-volatile memories of the toner cartridges.

An alternative constitution is also contemplated wherein the apparatus main body and the respective non-volatile memories of the toner cartridges are interconnected by means of one wire bus so that all the toner cartridges are sequentially accessed for data retrieval.

In this case, however, substantial time is taken to retrieve the data by sequentially accessing all the toner cartridges. More recently, the non-volatile memory of the toner cartridge, in particular, has been increased in capacity and hence, an enormous quantity of time is taken to retrieve the information stored in all the non-volatile memories of the toner cartridges.

SUMMARY OF THE INVENTION

It is an object of the invention to provide an image forming apparatus removably mounted with a toner cartridge equipped with a non-volatile memory, the apparatus which permits the toner cartridge to be replaced without suspending the image forming operation and which facilitates the confirmation of a mounted state of the toner cartridge, the retrieval of the information from the non-volatile memory of the mounted toner cartridge, and the like.

The image forming apparatus according to the invention comprises:

an apparatus main body including a mounting portion mounted with a toner cartridge equipped with a non-volatile memory storing a variety of information items;

a toner-cartridge mounting panel capable of being opened/closed without suspending an image forming operation when the toner cartridge is mounted in the mounting portion of the apparatus main body;

a main-body memory for storing a variety of information items;

a detection portion for detecting an opened/closed status of the toner-cartridge mounting panel;

a retrieval portion for retrieving cartridge-specific information from the non-volatile memory of the toner cartridge in a case where the opened/closed status of the toner-cartridge mounting panel is detected by the detection portion;

a comparator for comparing the cartridge-specific information retrieved by the retrieval portion with cartridge-specific information stored in the main-body memory;

a data reading portion for reading out the other data from the non-volatile memory of the toner cartridge, the cartridge-specific information of which is determined, by the comparator, to be different from the cartridge-specific information stored in the main-body memory; and a writing portion for storing the data read out by the data reading portion in the main-body memory.

In an image forming apparatus in which a toner cartridge equipped with a non-volatile memory storing a variety of information items is mounted in a mounting portion provided with a toner-cartridge mounting panel, a method of acquiring toner-cartridge information according to the invention comprises the steps of:

retrieving cartridge-specific information from the non-volatile memory of the toner cartridge when an opened/closed status of the toner-cartridge mounting panel is detected;

comparing the retrieved cartridge-specific information with cartridge-specific information stored in a main-body memory disposed in the image forming apparatus;

reading out the other data from the non-volatile memory of the toner cartridge, the cartridge-specific information of which is determined to be different from the cartridge-specific information stored in the main-body memory; and storing the read-out data in the main-body memory.

According to the invention, a toner cartridge removably mounted in an apparatus main body of an image forming apparatus provided with an openable toner-cartridge mounting panel, comprises:

a toner; and a non-volatile memory, wherein the non-volatile memory stores at least cartridge-specific information, communicatably connected to the apparatus main body as mounted in the main body, and transmits the cartridge-specific information to the apparatus main body in response to a control signal sent from the apparatus main body responding to the motion of the toner-cartridge mounting panel opened and closed when the toner cartridge is mounted.

The invention is constituted such that when the toner cartridge with the non-volatile memory storing the various information items is mounted in the mounting portion of the apparatus main body, the toner-cartridge mounting panel may be opened and closed without suspending the image forming operation, thus permitting the toner cartridge to be mounted in the mounting portion of the apparatus main body. Unlike the conventional image forming apparatuses, the apparatus of the invention does not require the temporary suspension of the image forming operation for replacing the toner cartridge. Hence, the apparatus of the invention is able to perform the continuous image forming operation, so as to be increased in the image forming efficiency.

The invention is constituted such that in a case where the opened/closed status of the toner-cartridge mounting panel is detected by the detection portion, the retrieval portion retrieves the cartridge-specific information from the non-volatile memory disposed in the toner cartridge. Therefore, the retrieval portion needs to retrieve the cartridge-specific information from the non-volatile memory of the toner cartridge only when the opened/closed status of the toner-cartridge mounting panel is detected by the detection portion. This results in the reduced number of retrievals made by the retrieval portion.

The invention is constituted such that the comparator compares the cartridge-specific information retrieved by the retrieval portion with the cartridge-specific information stored in the main-body memory, while the data reading portion reads the other data only from the non-volatile memory of the toner cartridge, the cartridge-specific information of which differs from the cartridge-specific information stored in the main-body memory. Therefore, it is unnecessary for the data reading portion to read out the other data in a case where the retrieved cartridge-specific information coincides with the cartridge-specific information stored in the main-body memory. This leads to less need for the data reading portion to read the data from the non-volatile memory of the toner cartridge.

As a result, the invention achieves the reduction of operations of confirming the mounted state of the toner cartridge, reading out the information from the non-volatile memory of the mounted toner cartridge, and such.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

An image forming apparatus according to the embodiments of the invention will be specifically described with reference to the accompanying drawings. It is noted that the image forming apparatus according to the invention is not limited to those illustrated by the following embodiments and modifications or changes may be made thereto as needed so long as such modifications or changes do not deviated from the scope of the invention.

Figure 1:
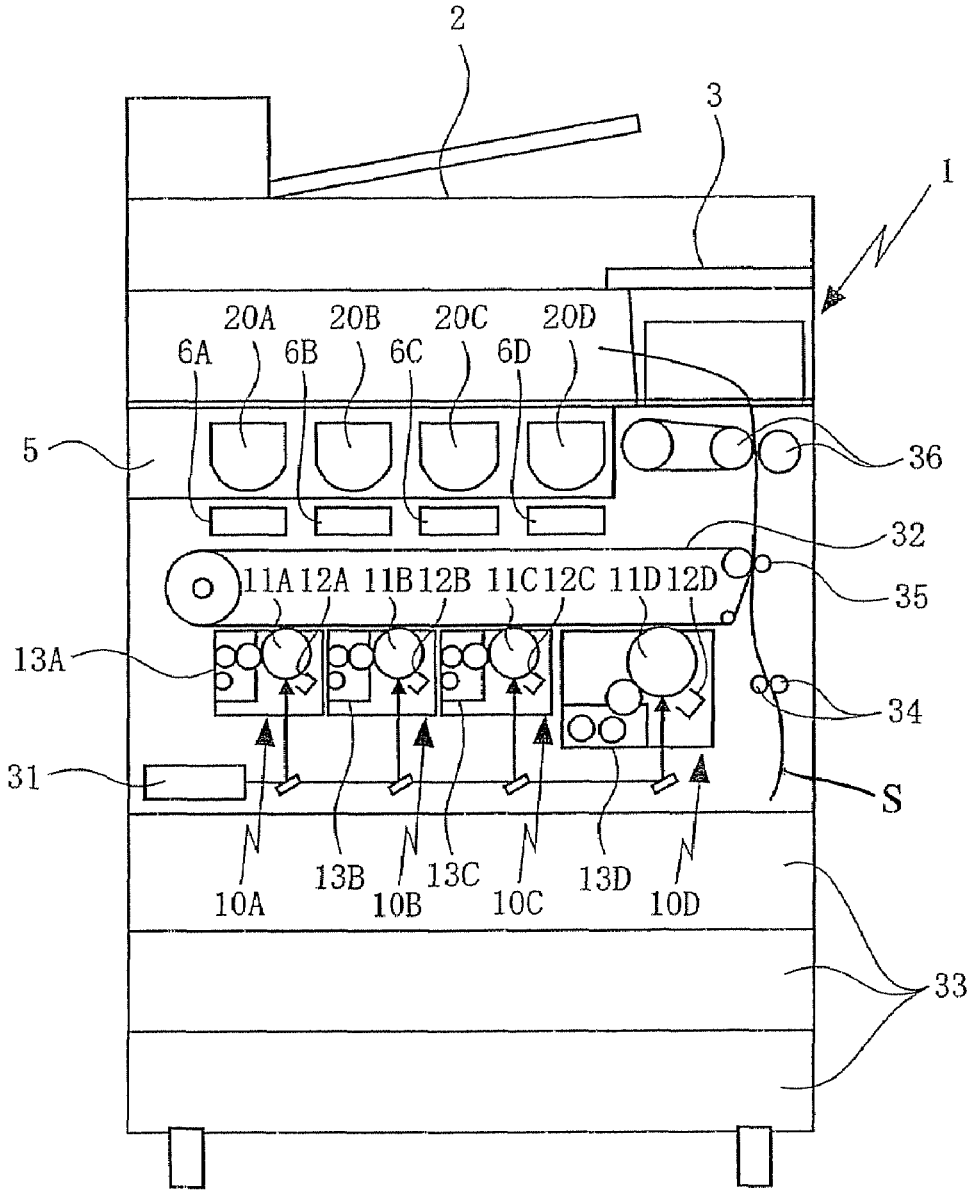
FIG. 1 is a schematic sectional view showing an internal structure of an image forming apparatus according to one embodiment of the invention.
Figure 2:
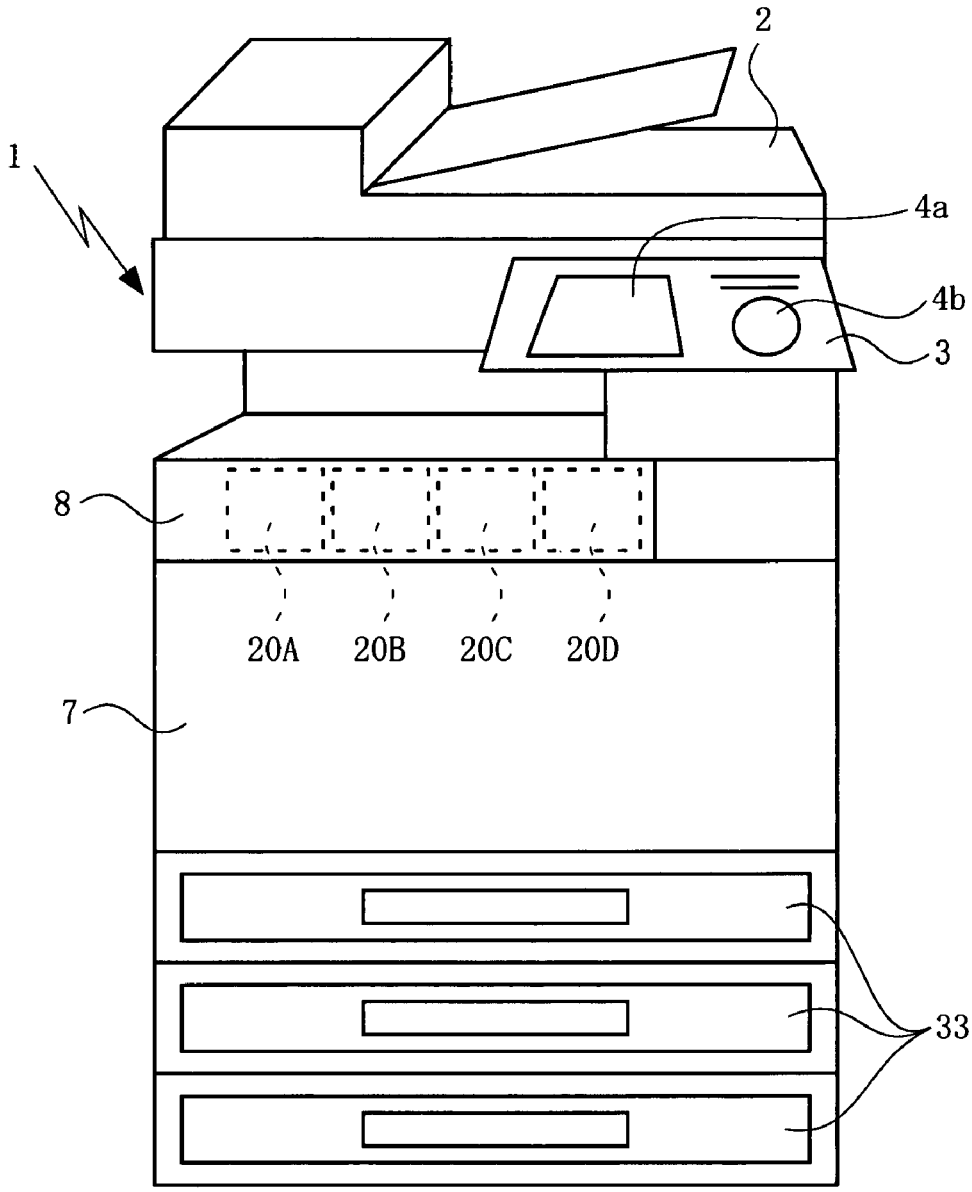
FIG. 2 is a schematic perspective view showing the image forming apparatus of the above embodiment.

As shown in FIG. 1 and FIG. 2, the image forming apparatus of the embodiment has an arrangement wherein an image reading device 2 for reading an image is disposed at an upper part of an apparatus main body 1, and an operation panel 3 including a display portion 4*a*, a print button 4*b* and the like is disposed at place downward from the image reading device 2.

Furthermore, four imaging units 10A to 10D are removably mounted in the main body 1 of the image forming apparatus. The imaging units 10A to 10D individually include: photosensitive members 11A to 11D; chargers 12A to 12D for electrically charging the surfaces of the photosensitive members 11A to 11D; and developing devices 13A to 13D for supplying toners to electrostatic latent images formed on the surfaces of the photosensitive members 11A to 11D, thereby forming toner images.

The developing devices 13A to 13D of the imaging units 10A to 10D each contain a two-component developer including a toner and a carrier.

According to the embodiment, the developing device 13A of the first imaging unit 10A employs a yellow toner, the developing device 13B of the second imaging unit 10B employing a magenta toner, the developing device 13C of the third imaging unit 10C employing a cyan toner, the developing device 13D of the fourth imaging unit 10D employing a black toner.

According to the embodiment, the fourth imaging unit 10D employing the more frequently-used black toner is larger than the other imaging units 10A to 10C.

Four toner cartridges 20A to 20D are removably mounted in a mounting portion 5 in the apparatus main body 1 in correspondence to the four imaging units 10A to 10D, the toner cartridges containing therein the toners supplied to the respective developing devices 13A to 13D of the imaging units 10A to 10D.

Figure 3:
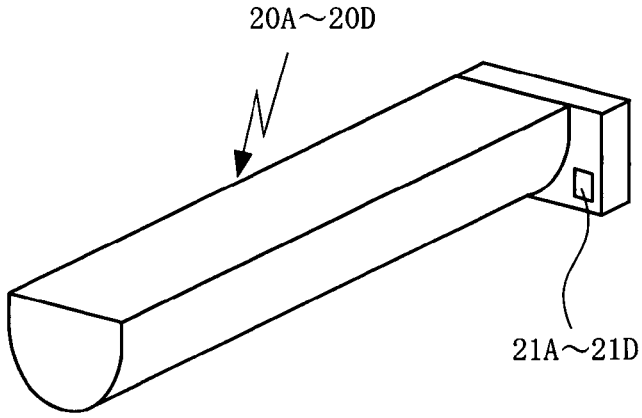
FIG. 3 is a schematic perspective view showing a toner cartridge used in the image forming apparatus of the above embodiment.

As shown in FIG. 3, the toner cartridges 20A to 20D are provided with non-volatile memories 21A to 21D, respectively. These non-volatile memories 21A to 21D each store a variety of information items including cartridge-specific information, color information for identification of the toner color, orientation information, manufacturer's serial number, toner quantity information, use conditions and the like.

In the main body 1 of the image forming apparatus of the embodiment, four toner storage hoppers 6A to 6D for temporarily storing the toners supplied from the toner cartridges 20A to 20D to the imaging units 10A to 10D are disposed between the toner cartridges 20A to 20D and the imaging units 10A to 10D.

The following constitution is made such that the toner cartridges 20A to 20D may supply the respective toners to the corresponding toner storage hoppers 6A to 6D. The toner storage hoppers 6A to 6D are each provided with a residual quantity sensor (not shown) for sensing the quantity of toner stored in the storage hopper. In a case where the quantity of toner in each of the toner storage hoppers 6A to 6D is decreased to a predetermined quantity or less, each of the toner cartridges 20A to 20D supplies the toner to each corresponding toner storage hopper 6A to 6D.

Figure 4:
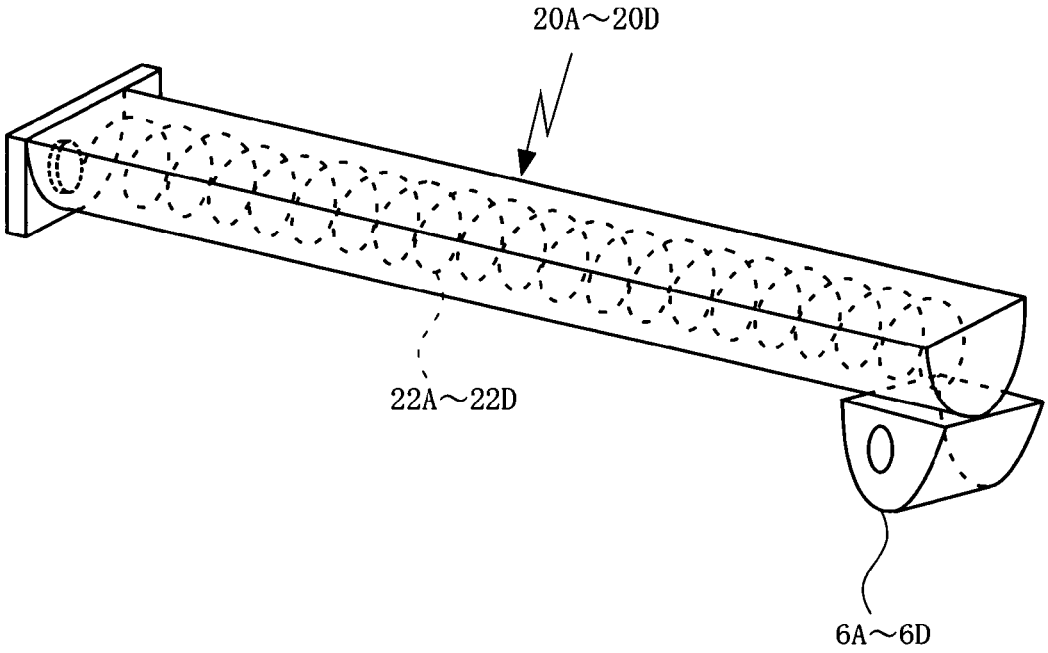
FIG. 4 is a schematic diagram explaining how the toner cartridge supplies a toner to a toner storage hopper in the image forming apparatus of the above embodiment.

The toner cartridges 20A to 20D supply the respective toners to the toner storage hoppers 6A to 6D as follows. As shown in FIG. 4, spiral springs 22A to 22D disposed in the toner cartridges 20A to 20D are rotated, while shutters (not shown) disposed between the toner cartridges 20A to 20D and the toner storage hoppers 6A to 6D are opened to allow the toners contained in the toner cartridges 20A to 20D to be supplied to the toner storage hoppers 6A to 6D.

The toners are supplied from the toner storage hoppers 6A to 6D to the developing devices 13A to 13D in the imaging units 10A to 10D as follows. The developing devices 13A to 13D are each provided with a density sensor (not shown) When the toner density determined by the density sensor is decreased to a predetermined value or less, each of the toner storage hoppers 6A to 6D supplies the toner to each corresponding developing device.

In addition to a front panel 7 permitting the replacement of the imaging units 10A to 10D, the image forming apparatus of the embodiment further includes a toner-cartridge mounting panel 8 on a front side of the mounting portion 5, the toner-cartridge mounting panel permitting the mounting of the toner cartridges 20A to 20D. Thus, the image forming apparatus is adapted to permit the toner-cartridge mounting panel 8 to be opened and closed without suspending the image forming operation.

The image forming apparatus of the embodiment forms a full-color image as follows. The surfaces of the photosensitive members 11A to 11D of the imaging units 10A to 10D are electrically charged by the chargers 12A to 12D. Subsequently, electrostatic latent images corresponding to respective image information pieces are formed on the respective surfaces of the charged photosensitive members 11A to 11D by means of a latent-image forming device 31. The developing devices 13A to 13D of the imaging units 10A to 10D supply the toners of the respective colors to the surfaces of the photosensitive members 11A to 11D having the electrostatic latent images thus formed thereon, whereby toner images of the respective colors are formed on the respective surfaces of the photosensitive members 11A to 11D.

The toner images of the respective colors so formed on the respective surfaces of the photosensitive members 11A to 11D of the imaging units 10A to 10D are sequentially transferred to an intermediate transfer belt 32, whereby a full-color toner image is formed on the intermediate transfer belt 32.

On the other hand, a timing roller 34 operates in a proper timing to introduce a recording medium S from a sheet cartridge 33 into space between the intermediate transfer belt 32 and a transfer roller 35, so that the full-color toner image formed on the intermediate transfer belt 32 may be transferred to the recording medium S. The full-color toner image thus transferred is fixed to the recording medium S by means of a fixing device 36 and then, the recording medium S is discharged.

Figure 5:
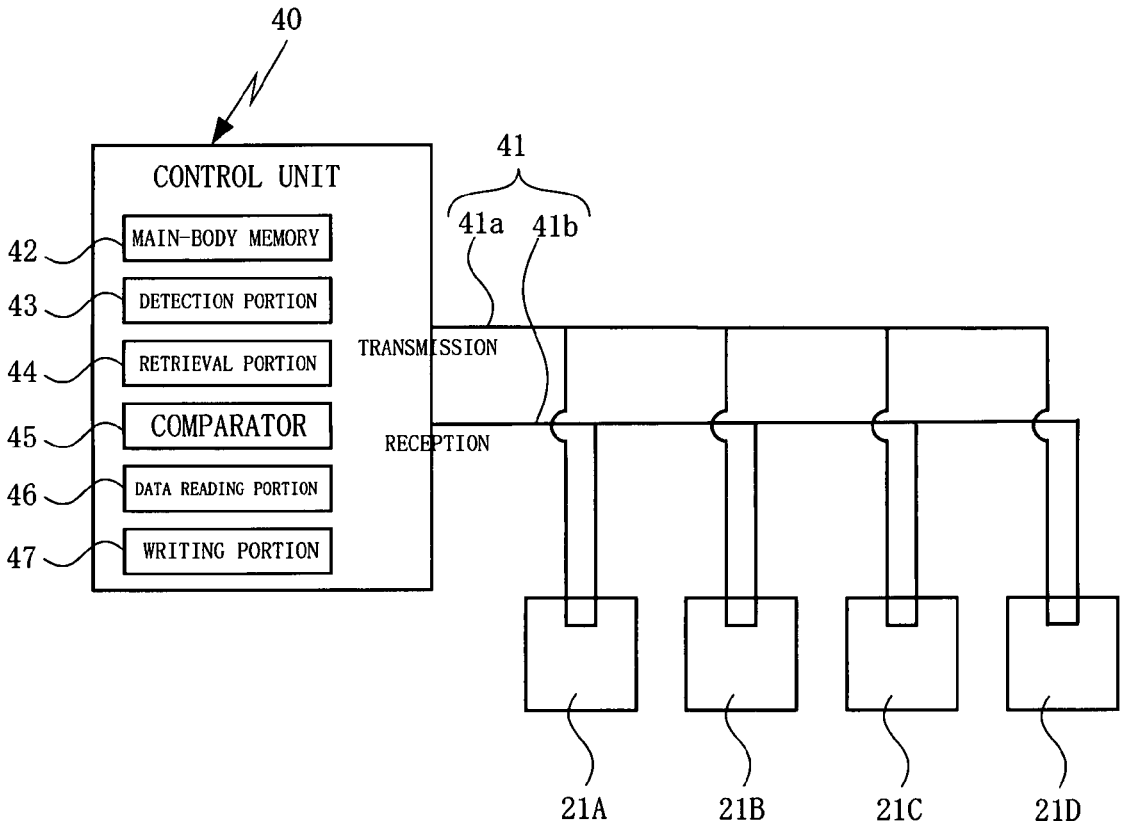
FIG. 5 is a block diagram of the image forming apparatus of the above embodiment.

According to the image forming apparatus of the embodiment, as shown in FIG. 5, a control unit 40 provided in the apparatus main body 1 is connected with the respective non-volatile memories 21A to 21D of the toner cartridges 20A to 20D mounted in the mounting portion 5 by means of one wire bus 41, so that the control unit may communicate with the non-volatile memories. Specifically, the apparatus main body 1 is connected with the respective non-volatile memories 21A to 21D of the toner cartridges 20A to 20D by means of a single transmission line 41*a* and a single reception line 41*b*, as shown in FIG. 5. The non-volatile memories 21A to 21D are connected in parallel.

Figure 6:
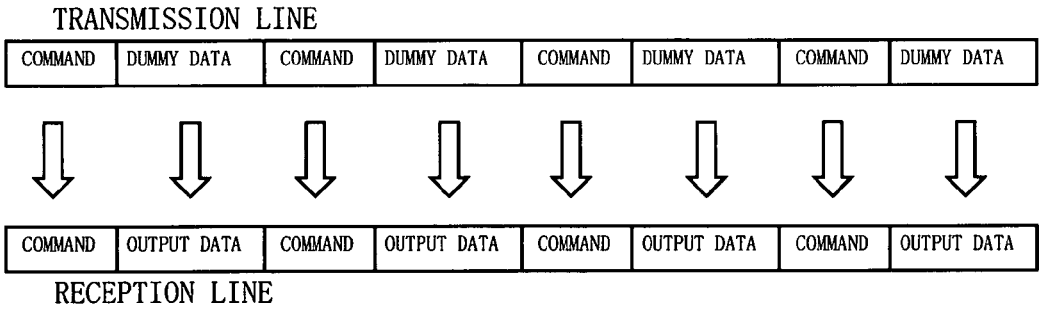
FIG. 6 is a schematic diagram illustrating how a control unit and respective non-volatile memories of the toner cartridges communicate with each other via one wire bus in the image forming apparatus of the above embodiment.

The control unit 40 disposed in the apparatus main body 1 communicates with the respective non-volatile memories 21A to 21D of the toner cartridges 20A to 20D as follows by means of the one wire bus 41. As shown in FIG. 6, the control unit 40 alternately transmits a command and dummy data to the respective non-volatile memories 21A to 21D of the toner cartridges 20A to 20D via the transmission line 41*a*, and receives the command and output data from the respective non-volatile memories 21A to 21D via the reception line 41*b*, the output data applied from the respective non-volatile memories in correspondence to the above command.

The above control unit 40 includes: a main-body memory 42 for storing a variety of information items; a detection portion 43 for detecting an opened/closed status of the toner-cartridge mounting panel 8; a retrieval portion 44 for retrieving the cartridge-specific information including an ID code and stored in the respective non-volatile memories 21A to 21D of the toner cartridges 20A to 20D; a comparator 45 for comparing the cartridge-specific information retrieved by the retrieval portion 44 with cartridge-specific information stored in the above main-body memory 42; a data reading portion 46 for accessing any one of the non-volatile memories 21A to 21D of the toner cartridges 20A to 20D that the comparator 45 determines the retrieved cartridge-specific information to be different from the cartridge-specific information stored in the main-body memory 42, so as to read therefrom the other data than the cartridge-specific information; a writing portion 47 for committing the data read out by the data reading portion 46 to storage in the main-body memory 42; and the like. The above main-body memory 42 may include a non-volatile memory and a volatile memory such that the volatile memory may store information to be temporarily stored.

In a case where the toner-cartridge mounting panel 8 is opened and closed in order to replace one or more of the above toner cartridges 20A to 20D, the opened/closed status thereof is detected by the detection portion 43 and the control unit communicates with the non-volatile memories 21A to 21D of the toner cartridges 20A to 20D via the wire bus 41.

Then, the retrieval portion 44 retrieves the cartridge-specific information composed of the ID code from the respective non-volatile memories 21A to 21D of the toner cartridges 20A to 20D.

As needed, the data reading portion 46 reads out toner color information from the respective non-volatile memories 21A to 21D, while the writing portion 47 combines the cartridge-specific information with the color information and stores these information items in the main-body memory 42.

The comparator 45 compares the cartridge-specific information already stored in the main-body memory 42 with the cartridge-specific information thus retrieved from the respective toner cartridges 20A to 20D. The other data is read from the non-volatile memory 21A to 21D of the toner cartridge 20A to 20D, the retrieved cartridge-specific information of which is determined to be different from the cartridge-specific information stored in the main-body memory. The writing portion stores the read-out data in the main-body memory 42.

In a case where the other data is read out from any of the non-volatile memories 21A to 21D of the toner cartridges 20A to 20D, the control unit 40 of the apparatus main body 1 transmits a control signal including the cartridge-specific information associated with the other data to be readout. Then, the non-volatile memory 21A to 21D of the toner cartridge 20A to 20D corresponding to the cartridge-specific information in question transmits the data to the control unit 40 of the apparatus main body 1. The transmitted data may include all the data items stored in the non-volatile memory 21A to 21D or otherwise, may include some of the un-transmitted data items.

Figure 7:
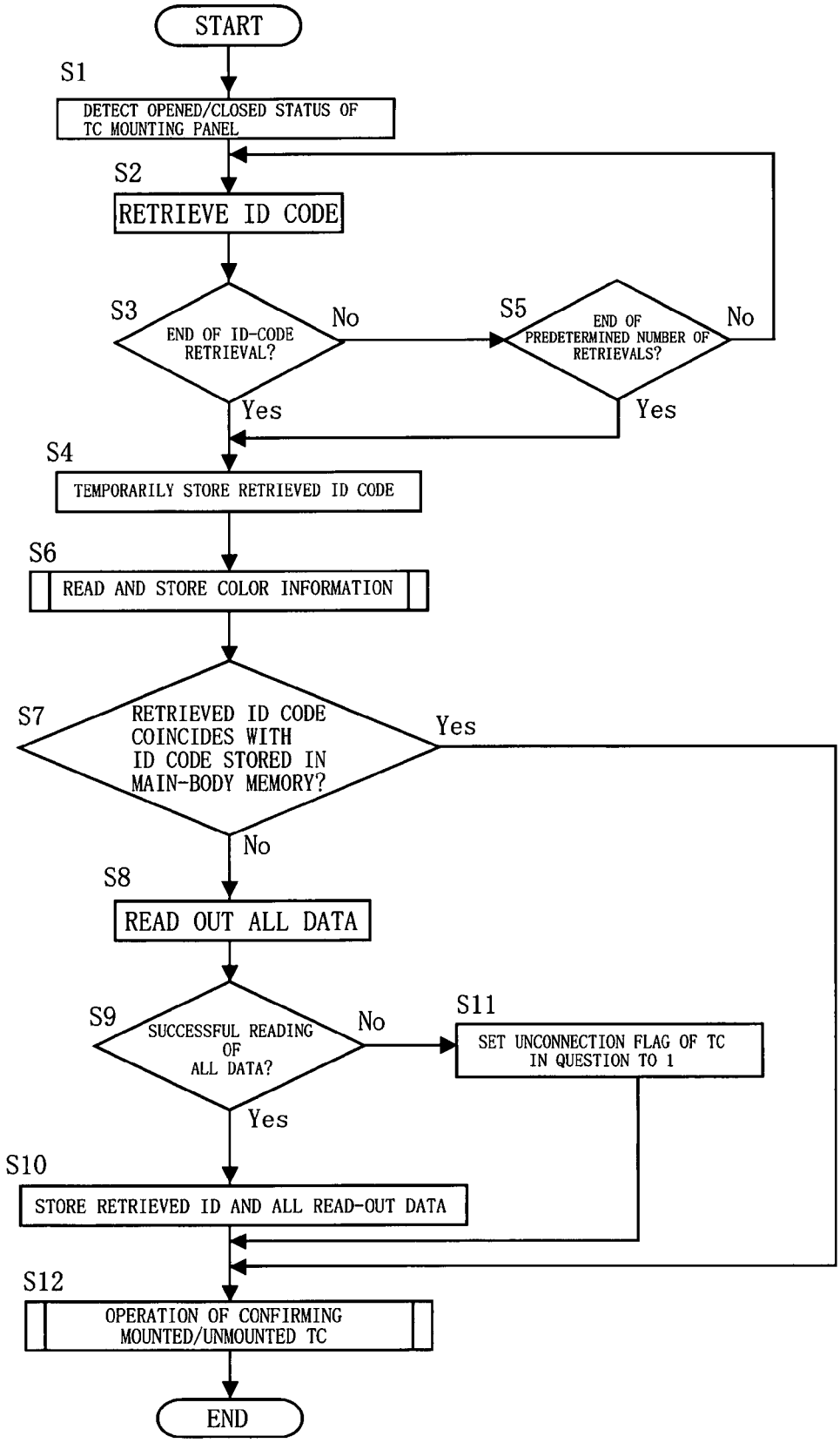
FIG. 7 is a flow chart showing the steps of operations of confirming the mounted state of the toner cartridge and acquiring necessary data, the operations performed by the image forming apparatus of the above embodiment.

Next, exemplary operations of confirming the toner cartridges 20A to 20D mounted in the mounting portion 5 of the apparatus main body 1 and acquiring the necessary data are described with reference to a flow chart shown in FIG. 7, the operations performed when the toner-cartridge mounting panel 8 of the above image forming apparatus is opened and closed. In the flow chart of FIG. 7, the toner cartridge is abbreviated as TC.

Firstly, when the aforesaid detection portion detects the opened/closed status of the toner-cartridge mounting panel in Step S1, the operation flow proceeds to Step S2 where the retrieval portion communicates with the respective non-volatile memories of the toner cartridges mounted in the mounting portion, thereby retrieving the ID code as the cartridge-specific information stored in the respective non-volatile memories of the toner cartridges.

Subsequently, determination is made in Step S3 as to whether the retrieval of the ID code is accomplished or not. As to a toner cartridge, the retrieval of whose ID code is accomplished, the operation flow proceeds to Step S4 where the retrieved ID code is temporarily stored in the main-body memory. As to a toner cartridge, the retrieval of whose ID code is yet to be accomplished, the operation flow proceeds to Step S5 where determination is made as to whether a predetermined number of retrievals of the ID code are made or not. If the predetermined number of retrievals are not made, the operation flow returns to the above Step S2 so as to perform the predetermined number of retrievals of the ID code. As to a toner cartridge the retrieval of whose ID code is determined in Step S3 to be accomplished before the predetermined number of retrievals are made, the operation flow proceeds to Step S4 as described above, where the retrieved ID code is temporarily stored in the main-body memory. The reason for making the predetermined number of retrievals of the ID code is because a temporary contact failure or the like may temporarily disables the retrieval of the ID code.

After the ID code thus retrieved is temporarily stored in the main-body memory, the operation flow proceeds to Step S6 to perform a color-information reading operation wherein the color information is read out from the respective non-volatile memories of the toner cartridges and is combined with the above retrieved ID code so as to be temporarily stored in the main-body memory. The color-information reading and storing operations in Step S6 are performed according to a subroutine shown in FIG. 8, which will be described hereinlater.

Subsequently, the operation flow proceeds to Step S7 where the comparator compares the ID code thus retrieved with the ID code stored in the main-body memory. As to a toner cartridge the ID code of which coincides with the ID code stored in the main-body memory, the operation flow proceeds to Step S12 to perform an operation of storing a mounted/unmounted state of toner cartridge.

As to a toner cartridge the ID code of which does not coincide with the ID code stored in the main-body memory, on the other hand, the operation flow proceeds to Step S8 to read out all the data items from the non-volatile memory thereof. In the subsequent Step S9, determination is made as to whether all the data times are successfully read out or not.

As to a toner cartridge all the data items of which are successfully read out, the operation flow proceeds to Step S10 to store the above retrieved ID code and the all the read-out data times in the main-body memory. Subsequently, the operation flow proceeds to Step S12 to perform the operation of storing the mounted/unmounted state of toner cartridge. As to a toner cartridge all the data items of which are not successfully read out, on the other hand, the operation flow proceeds to Step S11 to set an unconnection flag of the toner cartridge in question to 1, which is temporarily stored the main-body memory. Subsequently, the operation flow proceeds to Step S12 to perform the operation of storing the mounted/unmounted state of toner cartridge.

In Step S12, the operation of storing the mounted/unmounted state of toner cartridge is performed to complete the above operations. The operation of storing the mounted/unmounted state of toner cartridge is performed according to a subroutine shown in FIG. 9, which will be described hereinlater.

Figure 8:
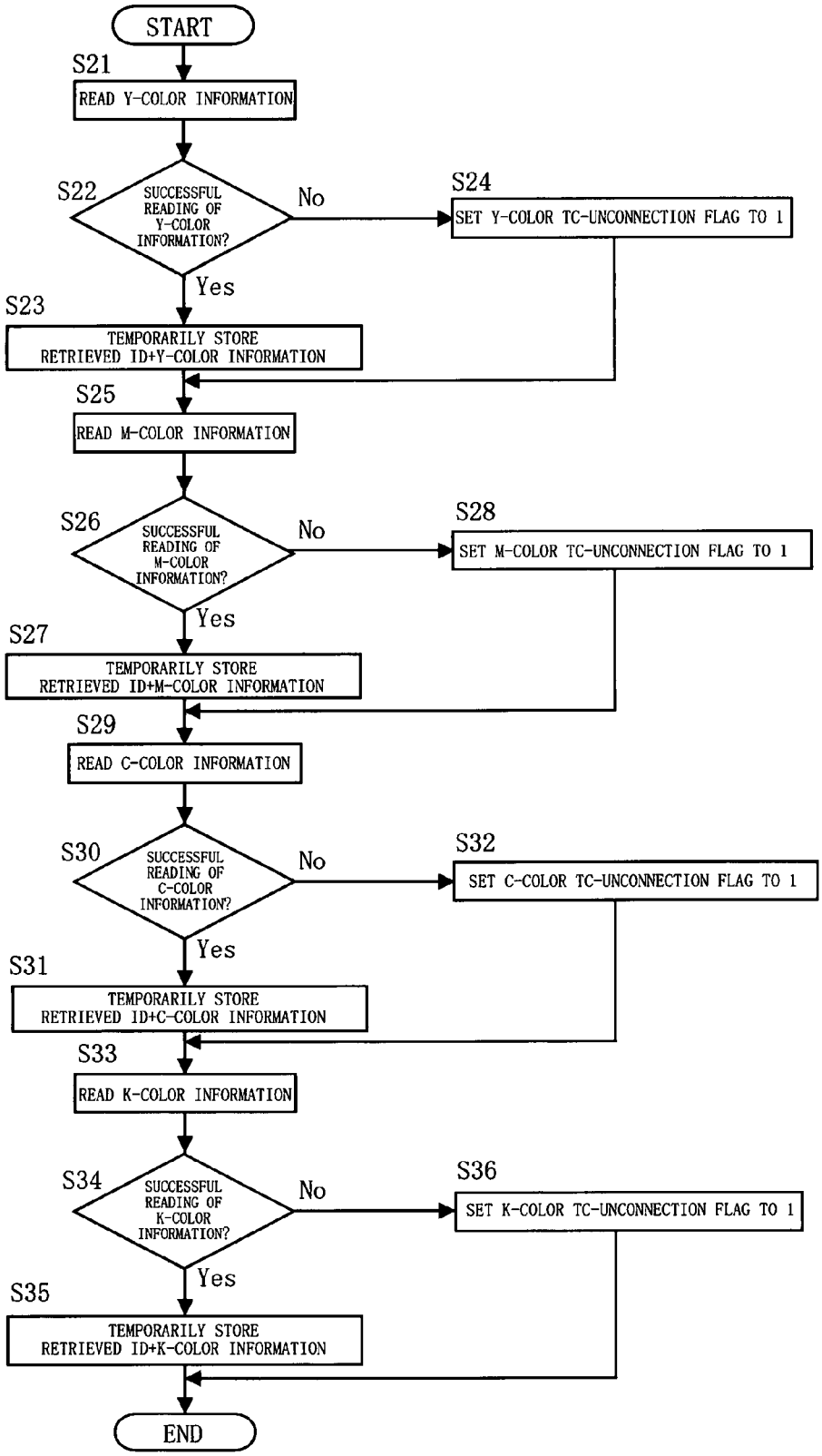
FIG. 8 is a flow chart showing the steps of a subroutine for performing an operation of reading and storing color information in the flow chart shown in FIG. 7.

Next, the color-information reading/storing operations in Step S6 are described with reference to a flow chart shown in FIG. 8. In the flow chart of FIG. 8, the toner cartridge is abbreviated as TC, the yellow color abbreviated as Y-color, the magenta color abbreviated as M-color, the cyan color abbreviated as C-color, the black color abbreviated as K-color.

The color-information reading/storing operations are performed as follows. In Step S21, firstly, yellow color information is read out from the respective non-volatile memories of the toner cartridges. In Step S22, determination is made as to whether the reading of the yellow color information is successful or not. If the reading of the yellow color information is successful, the operation flow proceeds to Step S23 where the retrieved ID code of the toner cartridge of interest along with the yellow color information are temporarily stored in the main-body memory as confirmation of the connection of the toner cartridge of interest. Hence, the operation flow proceeds to Step S25. On the other hand, if the reading of the yellow color information is unsuccessful, the operation flow proceeds to Step S24 where an unconnection flag of the yellow toner cartridge is set to 1, which is temporarily stored in the main-body memory. Then, the operation flow proceeds to Step S25.

In Step S25, magenta color information is read out from the respective non-volatile memories of the toner cartridges. In Step S26, determination is made as to whether the reading of the magenta color information is successful or not. If the reading of the magenta color information is successful, the operation flow proceeds to Step S27 where the retrieved ID code of the toner cartridge of interest along with the magenta color information are temporarily stored in the main-body memory as confirmation of the connection of the toner cartridge of interest. Hence, the operation flow proceeds to Step S29. On the other hand, if the reading of the magenta color information is unsuccessful, the operation flow proceeds to Step S28 where an unconnection flag of the magenta toner cartridge is set to 1, which is temporarily stored in the main-body memory. Then, the operation flow proceeds to Step S29.

In Step S29, cyan color information is read out from the respective non-volatile memories of the toner cartridges. In Step S30, determination is made as to whether the reading of the cyan color information is successful or not. If the reading of the cyan color information is successful, the operation flow proceeds to Step S31 where the retrieved ID code of the toner cartridge of interest along with the cyan color information are temporarily stored in the main-body memory as confirmation of the connection of the toner cartridge of interest. Hence, the operation flow proceeds to Step S33. On the other hand, if the reading of the cyan color information is unsuccessful, the operation flow proceeds to Step S32 where an unconnection flag of the cyan toner cartridge is set to 1, which is temporarily stored in the main-body memory. Then, the operation flow proceeds to Step S33.

In Step S33, black color information is read out from the respective non-volatile memories of the toner cartridges. In Step S34, determination is made as to whether the reading of the black color information is successful or not. If the reading of the black color information is successful, the operation flow proceeds to Step S35 where the retrieved ID code of the toner cartridge of interest along with the black color information are temporarily stored in the main-body memory as confirmation of the connection of the toner cartridge of interest. On the other hand, if the reading of the black color information is unsuccessful, the operation flow proceeds to Step S36 where an unconnection flag of the black toner cartridge is set to 1, which is temporarily stored in the main-body memory. Thus, the above operations are completed.

Figure 9:
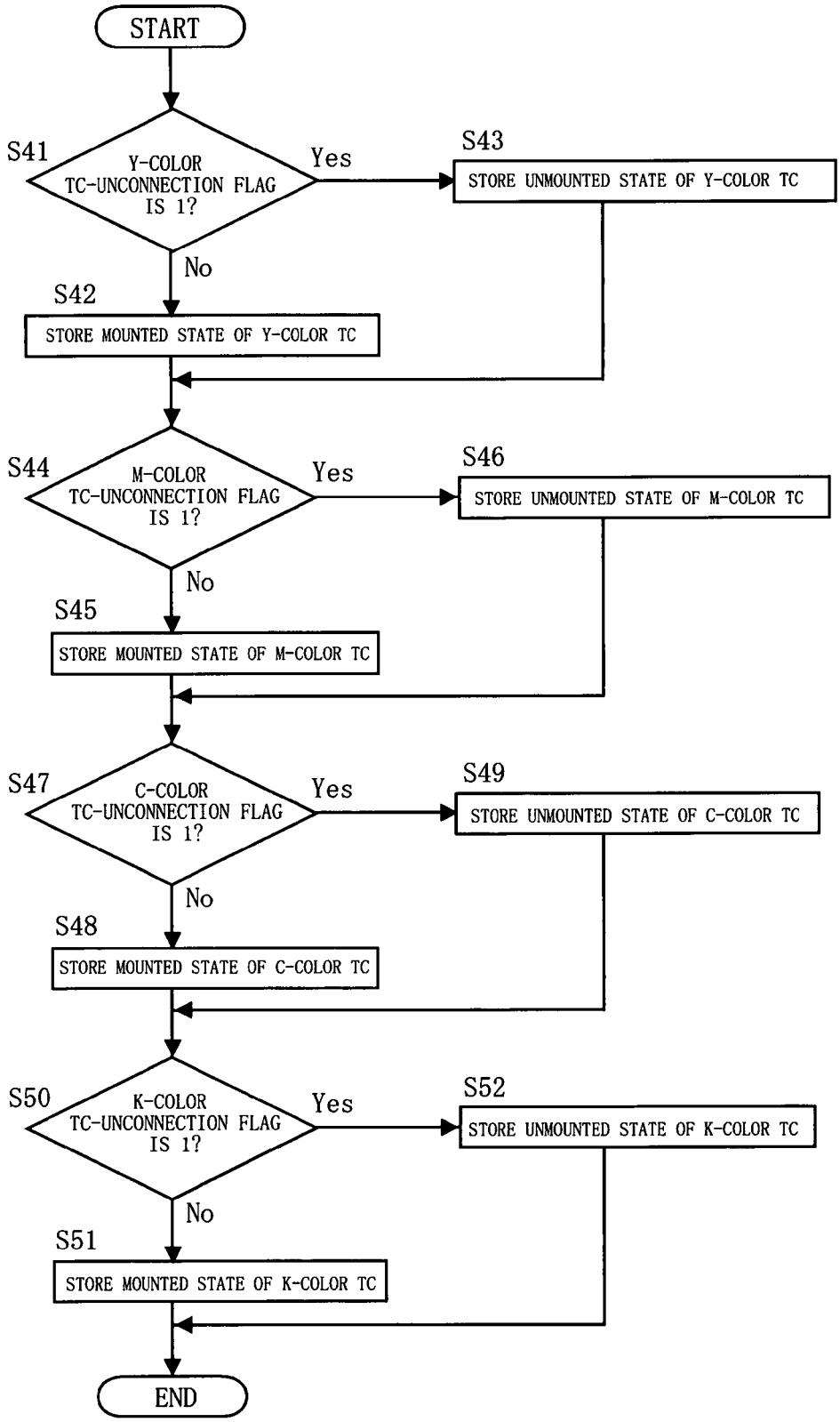
FIG. 9 is a flow chart showing the step of a subroutine for performing an operation of storing mounted/unmounted state of the toner cartridge in the flow chart shown in FIG. 7.

Next, the operation of storing the mounted/unmounted state of the toner cartridge in the aforementioned Step S12 is described with reference to a flow chart shown in FIG. 9. In the flow chart of FIG. 9, as well, the toner cartridge is abbreviated as TC, the yellow color abbreviated as Y-color, the magenta color abbreviated as M-color, the cyan color abbreviated as C-color, the black color abbreviated as K-color.

The operation of storing the mounted/unmounted state of the toner cartridge is performed as follows. In Step S41 firstly, determination is made as to whether the unconnection flag of the yellow toner cartridge is 1 or not. If the unconnection flag of the yellow toner cartridge is not 1, the operation flow proceeds to Step S42 where the mounted state of the yellow toner cartridge is stored in the main-body memory. On the other hand, if the unconnection flag of the yellow toner cartridge is 1, the operation flow proceeds to Step S43 where the unmounted state of the yellow toner cartridge is stored in the main-body memory. Then, the operation flow proceeds to Step S44.

In Step S44, determination is made as to whether the unconnection flag of the magenta toner cartridge is 1 or not. If the unconnection flag of the magenta toner cartridge is not 1, the operation flow proceeds to Step S45 where the mounted state of the magenta toner cartridge is stored in the main-body memory. On the other hand, if the unconnection flag of the magenta toner cartridge is 1, the operation flow proceeds to Step S46 where the unmounted state of the magenta toner cartridge is stored in the main-body memory. Then, the operation flow proceeds to Step S47.

In Step S47, determination is made as to whether the unconnection flag of the cyan toner cartridge is 1 or not. If the unconnection flag of the cyan toner cartridge is not 1, the operation flow proceeds to Step S48 where the mounted state of the cyan toner cartridge is stored in the main-body memory. On the other hand, if the unconnection flag of the cyan toner cartridge is 1, the operation flow proceeds to Step S49 where the unmounted state of the cyan toner cartridge is stored in the main-body memory. Then, the operation flow proceeds to Step S50.

In Step S50, determination is made in Step S50 as to whether the unconnection flag of the black toner cartridge is 1 or not. If the unconnection flag of the black toner cartridge is not 1, the operation flow proceeds to Step S51 where the mounted state of the black toner cartridge is stored in the main-body memory. On the other hand, if the unconnection flag of the black toner cartridge is 1, the operation flow proceeds to Step S52 where the unmounted state of the black toner cartridge is stored in the main-body memory. Thus, the above operation is completed.

Figure 10:
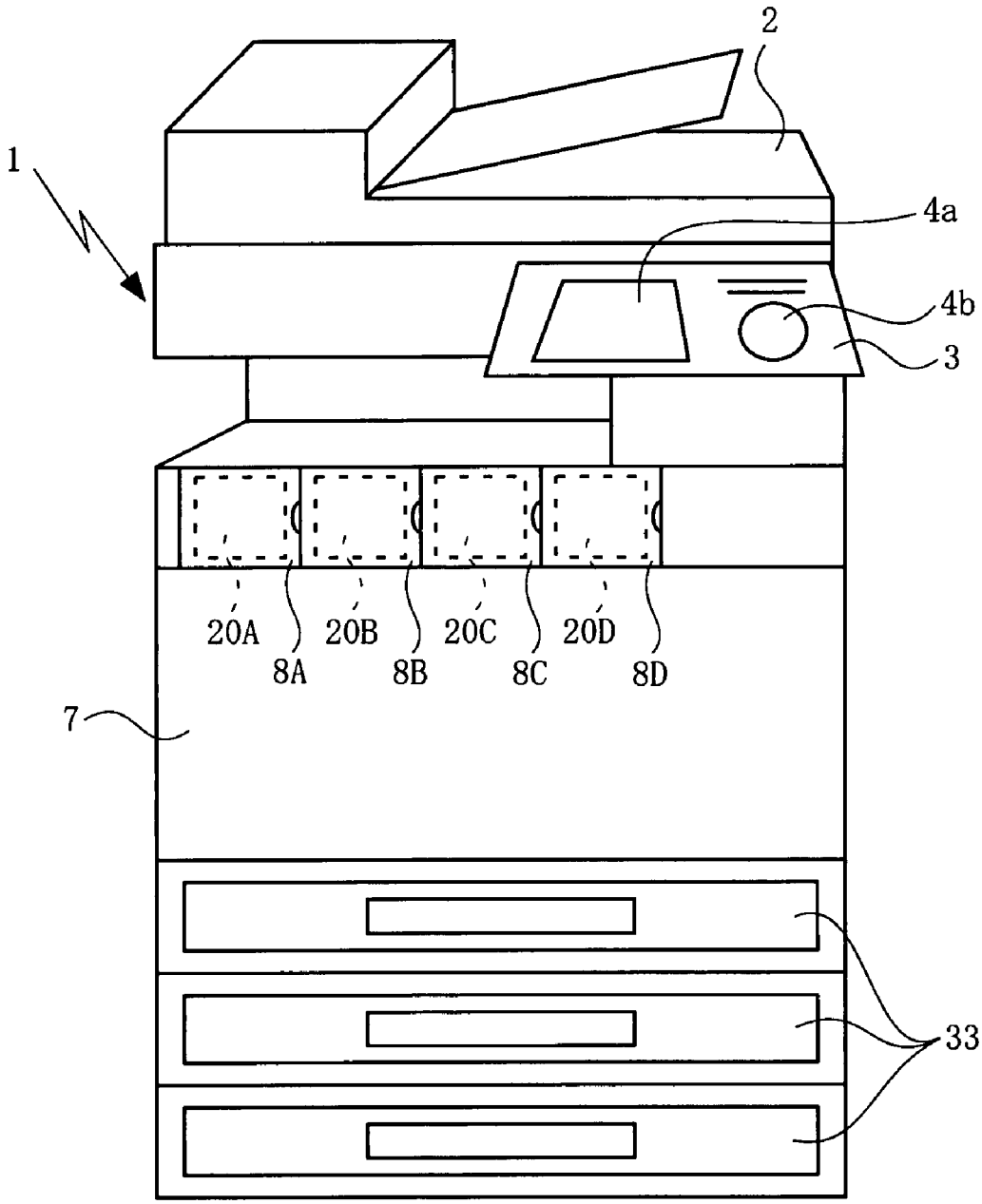
FIG. 10 is a schematic perspective view showing an modification of the image forming apparatus of the above embodiment, wherein toner-cartridge mounting panels are provided in one-on-one relation with the toner cartridges.

The image forming apparatus of the embodiment has the arrangement wherein a single toner-cartridge mounting panel 8 is disposed on the front side of the mounting portion 5 in which the four toner cartridges 20A to 20D are mounted. Alternatively, as shown in FIG. 10, four discrete toner-cartridge mounting panels 8A to 8D may also be disposed on the front side of the mounting portion in correspondence to the respective toner cartridges 20A to 20D.

In the case where the four toner-cartridge mounting panels 8A to 8D are disposed in correspondence to the four toner cartridges 20A to 20D, the detection portion 43 may be adapted for discrete detection of the opened/closed status of the respective toner-cartridge mounting panels 8A to 8D. In a case where only one of the four toner-cartridge mounting panels 8A to 8D, say the toner-cartridge mounting panel 8A is opened and closed, the aforesaid control unit 40 may transmit a command to select only one toner cartridge 20A mounted in correspondence to the toner-cartridge mounting panel 8A so opened/closed, such as to confirm the mounted state of the cartridge and to acquire the necessary data.

Figure 11:
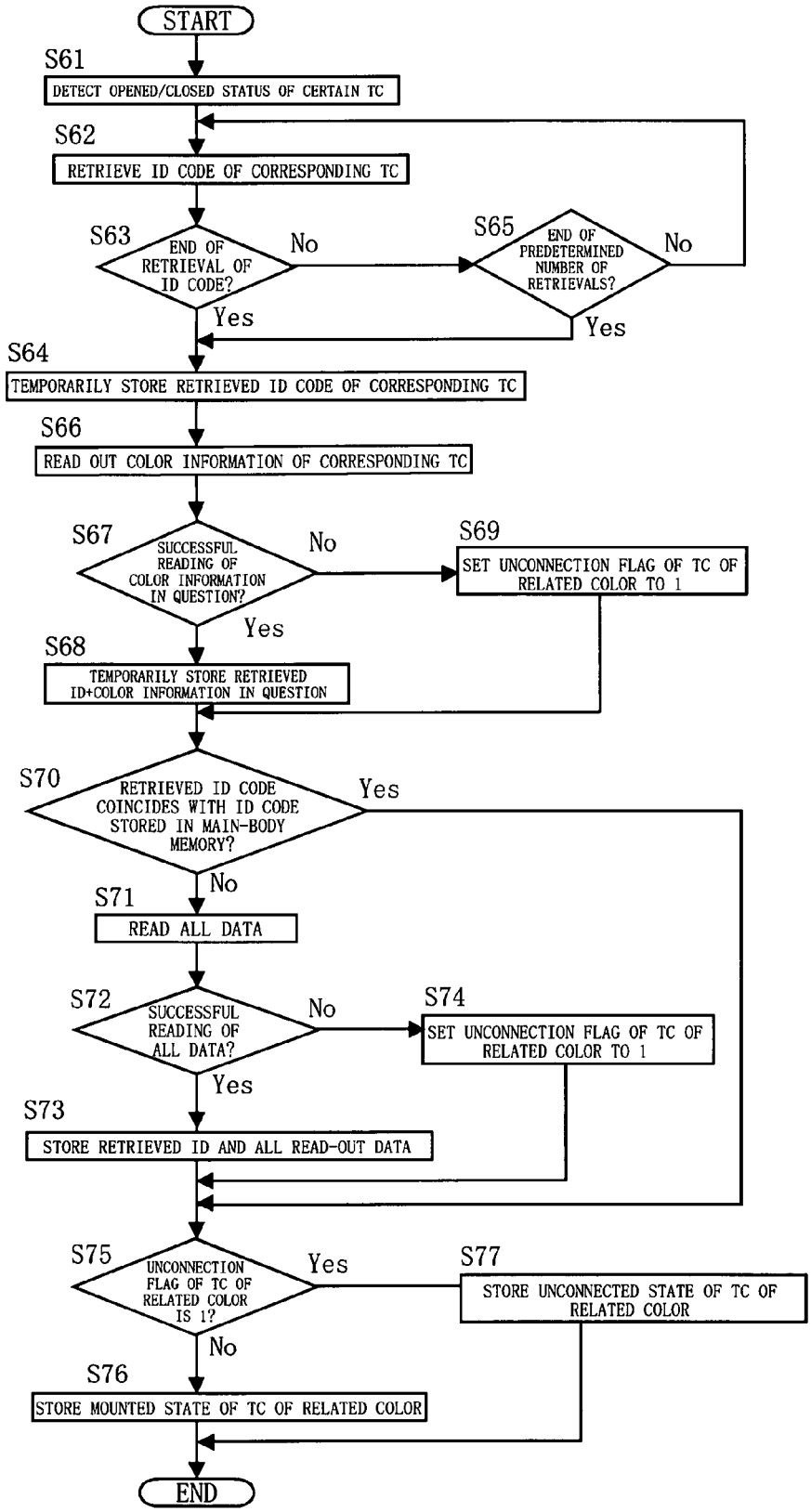
FIG. 11 is a flow chart showing the steps of operations of the modification of the image forming apparatus shown in FIG. 10, the operations performed in response to the open/close of one of the toner-cartridge mounting panels and for the purpose of confirming the mounted state of a toner cartridge corresponding to the toner-cartridge mounting panel of interest and acquiring necessary data.

Now referring to a flow chart shown in FIG. 11, description is made on operations performed in a case where any one of the toner-cartridge mounting panels is opened and closed. The operations are performed for confirming the mounted state of a certain toner cartridge corresponding to the toner-cartridge mounting panel in question and for acquiring the necessary data. In the flow chart of FIG. 11, as well, the toner cartridge is abbreviated as TC.

In Step S61 firstly, the detection portion detects the opened/closed status of the certain toner-cartridge mounting panel. In Step S62, the aforesaid retrieval portion retrieves an ID code, as the cartridge-specific information, from the non-volatile memory in the certain toner cartridge mounted in correspondence to the toner-cartridge mounting panel in question.

In the subsequent Step S63, determination is made as to whether the retrieval of the ID code is completed or not. If the retrieval of the ID code is completed, the operation flow proceeds to Step S64 where the retrieved ID code related to the above toner cartridge is temporarily stored in the main-body memory. If the retrieval of the ID code is not completed, on the other hand, the operation flow proceeds to Step S65 where determination is made as to whether a predetermined number of retrievals of the ID code are made or not. If the predetermined number of retrievals are not made, the operation flow returns to the above Step S62 so as to make the predetermined number of retrievals of the ID code. If the retrieval of the ID code is completed in Step S63 before a predetermined number of retrievals are made, the operation flow proceeds to Step S64, as described above, so that the ID code of the above toner cartridge is temporarily stored in the main-body memory.

Subsequently, the operation flow proceeds to Step S66 where the color information is read out from the non-volatile memory of the above toner cartridge. In Step S67 determination is made as to whether the color information corresponding to the certain toner cartridge is successfully read out or not. If the reading of the color information in question is successful, the operation flow proceeds to Step S68, where the retrieved ID code of the above toner cartridge along with the related color information are temporarily stored in the main-body memory as confirmation of the connection of the toner cartridge. Then, the operation flow proceeds to Step S70. On the other hand, if the reading of the color information in question is unsuccessful, the operation flow proceeds to Step S69 where the unconnection flag of the toner cartridge of the related color is set to 1, which is temporarily stored in the main-body memory. Then, the operation flow proceeds to Step S70.

In Step S70, the comparator compares the ID code thus retrieved with the ID code stored in the main-body memory so as to determined whether these ID codes coincide with each other or not. If the retrieved ID code coincides with the ID code stored in the main-body memory, the operation flow proceeds to Step S75 to be described hereinlater. On the other hand, if the retrieved ID code does not coincide with the ID code stored in the main-body memory, the operation flow proceeds to Step S71 to retrieve all the data items from the non-volatile memory. In Step S72, determination is made as to whether the retrieval of all the data items is successful or not.

If the retrieval of all the data items is successful, the operation flow proceeds to Step S73 where the above retrieved ID code and the all the data items thus retrieved are stored in the main-body memory. Subsequently, the operation flow proceeds to step S75. On the other hand, if the retrieval of all the data items is unsuccessful, the operation flow proceeds to Step S74 where the unconnection flag of the toner cartridge of the related color is set to 1, which is temporarily stored in the main-body memory. Then, the operation flow proceeds to Step S75.

In Step S75, determination is made as to whether the unconnection flag of the toner cartridge of the related color is 1 or not. If the unconnection flag of the toner cartridge of the related color is not 1, the operation flow proceeds to Step S76 where the mounted state of the toner cartridge of the related color is stored in the main-body memory. If the above unconnection flag is 1, on the other hand, the operation flow proceeds to Step S77 where the unmounted state of the toner cartridge of the related color is stored in the main-body memory. Thus, the operation is completed.

According to the image forming apparatus of the foregoing embodiments, all the four toner cartridges 20A to 20D are mounted in the mounting portion 5 of the apparatus main body 1. However, in a case where only one toner cartridge 20A is mounted in order to conduct an image forming test of the image forming apparatus, for example, the above control unit 40 may also be adapted to transmit a command to read only from the non-volatile memory 21A disposed in this toner cartridge 20A.

The image forming apparatus of the foregoing embodiments is constituted such that when the plural toner cartridges equipped with the non-volatile memories are mounted in the mounting portion of the apparatus main body, one wire bus is used for connecting the non-volatile memories of the toner cartridges to the apparatus main body. Therefore, the wirings and the like are quite simplified and the control is facilitated as compared with a case where the non-volatile memories of the toner cartridges are discretely connected to the apparatus main body and are discretely communicated therewith.

The image forming apparatus according to the foregoing embodiments requires the retrieval portion to perform a reduced number of retrievals as described above, or requires the data reading portion to perform a reduced number of readings of the other data from the non-volatile memories of the toner cartridges. Therefore, even in the aforementioned case where the individual non-volatile memories of the toner cartridges are connected to the apparatus main body by means of one wire bus and are communicated therewith, it is unnecessary to read out all the information stored in the non-volatile memories of all the toner cartridges as practiced in the prior art. Hence, the apparatus can achieve a notable reduction of time taken to confirm the mounted state of the toner cartridge, to read out the information from the non-volatile memory of the mounted toner cartridge or such.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. An image forming apparatus comprising:

an apparatus main body including a mounting portion mounted with a plurality of toner cartridges equipped with respective non-volatile memories storing a variety of information items;

a toner-cartridge mounting panel capable of being opened/closed without suspending an image forming operation when a toner cartridge of the plurality of toner cartridges is mounted in the mounting portion of the apparatus main body;

a main-body memory for storing a variety of information items;

a detection portion for detecting an opened/closed status of the toner-cartridge mounting panel;

a retrieval portion for retrieving only cartridge-specific information from the non-volatile memories of the plurality of toner cartridges every time the opened/closed status of the toner-cartridge mounting panel is detected by the detection portion;

a comparator for comparing the cartridge-specific information retrieved by the retrieval portion with cartridge-specific information stored in the main-body memory;

a data reading portion for reading out other data from the non-volatile memory of the toner cartridge in response to the cartridge-specific information being determined, by the comparator, to be different from the cartridge-specific information stored in the main-body memory; and a writing portion for storing the other data read out by the data reading portion in the main-body memory every time the other data is read out by the data reading portion in response to the cartridge-specific information being determined, by the comparator, to be different from the cartridge-specific information stored in the main-body memory.

2. An image forming apparatus according to claim 1, wherein the respective non-volatile memories of the toner cartridges are connected to the main-body memory by means of one wire bus.

3. An image forming apparatus according to claim 1, wherein the mounting portion is capable of mounting a plurality of toner cartridges equipped with non-volatile memories, and a plurality of toner-cartridge mounting panels are provided in correspondence to the respective toner cartridges, a toner-cartridge mounting panel opened and closed when a toner cartridge is mounted in the mounting portion of the main body.

4. An image forming apparatus according to claim 1, wherein a plurality of toner cartridges equipped with non-volatile memories are mounted in the mounting portion and toners contained in the respective toner cartridges have different colors.

5. An image forming apparatus according to claim 1, wherein the retrieval portion retrieves the cartridge-specific information and toner color information from the non-volatile memory disposed in the toner cartridge, and wherein the writing portion correlates the cartridge-specific information with the toner color information and stores these information items in the main-body memory.

6. An image forming apparatus according to claim 1, wherein the retrieval portion repeats the retrieval operation a predetermined number of times, the operation for retrieving the cartridge-specific information from the non-volatile memory of the toner cartridge.

7. In an image forming apparatus in which a plurality of toner cartridges equipped with respective non-volatile memories storing a variety of information items are mounted in a mounting portion provided with a toner-cartridge mounting panel, a method of acquiring toner-cartridge information comprising the steps of:

retrieving only cartridge-specific information from the non-volatile memories of the plurality of toner cartridges every time an opened/closed status of the toner-cartridge mounting panel is detected;

comparing the retrieved cartridge-specific information with cartridge-specific information stored in a main-body memory disposed in the image forming apparatus;

reading out other data from the non-volatile memory of a toner cartridge of the plurality of toner cartridges in response to the cartridge-specific information being determined to be different from the cartridge-specific information stored in the main-body memory; and storing the read-out other data in the main-body memory every time the other data is read out in response to the cartridge-specific information being determined to be different from the cartridge-specific information stored in the main-body memory.

8. A method of acquiring toner-cartridge information according to claim 7, wherein the cartridge-specific information and toner color information stored in the non-volatile memory of the toner cartridge are retrieved, and wherein the cartridge-specific information and the toner color information are correlated with each other and stored in the main-body memory.

9. A method of acquiring toner-cartridge information according to claim 7, wherein the operation of retrieving the cartridge-specific information from the non-volatile memory of the toner cartridge is repeated a predetermined number of times.

* * * * *